US005799863A

United States Patent [19]

Capy et al.

[11] Patent Number: 5,799,863

[45] Date of Patent: Sep. 1, 1998

[54] UNFOLDING CUP WITH PREFOLDED CONVEX BOTTOM

[76] Inventors: Gilbert Capy, La Botte, Jarnioux F-69640, France; Akiva Buchberg, 5030 Pine Tree Dr., Miami Beach, Fla. 33140

[21] Appl. No.: 737,807

[22] PCT Filed: Jun. 1, 1995

[86] PCT No.: PCT/FR95/00712

§ 371 Date: Nov. 29, 1996

§ 102(e) Date: Nov. 29, 1996

[87] PCT Pub. No.: WO95/33654

PCT Pub. Date: Dec. 14, 1995

[30] Foreign Application Priority Data

Jun. 2, 1994 [FR] France ..... 94 06969

[51] Int. Cl.[6] ..... B65D 3/08; B65D 5/36

[52] U.S. Cl. ..... 229/104; 229/110; 229/193; 229/405

[58] Field of Search ..... 229/104, 110, 229/117.05, 193, 405; 383/7, 104, 122; 248/150, 152

[56] References Cited

U.S. PATENT DOCUMENTS

| | | | |
|---|---|---|---|
| 1,690,586 | 11/1928 | Main | 229/117.05 |
| 1,985,111 | 12/1934 | Shofer et al. | 229/117.05 |
| 2,232,088 | 2/1941 | Waters | 229/104 |
| 2,323,287 | 7/1943 | Amberg | 229/193 |
| 2,385,898 | 10/1945 | Waters . | |
| 3,726,469 | 4/1973 | Koehler . | |
| 4,981,257 | 1/1991 | Radbruch | 229/193 |
| 5,312,035 | 5/1994 | Nold et al. | 229/193 |
| 5,356,069 | 10/1994 | Bochet et al. | 229/193 |

FOREIGN PATENT DOCUMENTS

| | | |
|---|---|---|
| 2707467 | 1/1995 | France . |
| 2710005 | 3/1995 | France . |
| 2712788 | 6/1995 | France . |
| 8800400 | 4/1988 | Germany . |

*Primary Examiner*—Gary E. Elkins

*Attorney, Agent, or Firm*—Greenblum & Bernstein, P.L.C.

[57] ABSTRACT

Cup made from a rectangular sheet folded to form a convex base consisting of two isosceles triangles with a common base. The ends of the common base extend into two areas in the shape of deformable lozenges for folding and unfolding the cup while leaving the base flat. When the cup is unfolded by pressing on the edges to draw them together, the ends abut on the edges of the dihedrals forming the cup sides, thereby locking the cup into an open position.

9 Claims, 7 Drawing Sheets

UNFOLDING CUP WITH PREFOLDED CONVEX BOTTOM

The present invention relates to the manufacture of foldable cups of the type described in the Patents FR-A-2707467, FR-A-2710005, FR-A-2712788, envisaging unfolding cups having a prefolded concave bottom allowing good locking.

The cups described in these patents have the main advantages of being able to be manufactured continuously from a reel of cardboard plastic-coated on one face, of having high-quality impermeability, of having a bottom which is very easy to unfold and perfectly locked, in the natural gripping direction, when drinking from this cup and of having a double wall in the gripping regions allowing good insulation of the user's fingers when the liquid is hot. The first problem with these cups is that they use a concave bottom and that, when the cup is used for consuming a drink which has to have sugar added, it is difficult to dissolve the sugar since the liquid has to be stirred in each of the two hollows formed by the concave bottom of the cup. The second problem is that stabilizing these cups is achieved by virtue of the addition of stabilizers which generally use a not inconsiderable additional quantity of cardboard; it is possible, however, in certain cases, to make savings in cardboard, which is to the detriment of the aesthetic appearance or of the simplicity of manufacture.

There are many patents which seek to resolve the problem of the concave bottom; they all work by reversing the concavity of the bottom so that the interior of the cup has a convex bottom including only one hollow at the centre; taking the patent U.S. Pat. No. 3,726,469 as an example, the bottom is obtained from a sheet folded into a "W" so that the central part serves to form the convex bottom, while the fold line separating the central part of the cup from the lateral parts serves as a polygon for resting the cup on a flat surface. Such a cup therefore has the advantage, in addition to the convex bottom, of having good stability which is obtained automatically by unfolding the assembly; a drawback is that unfolding it is done by pressing on the cup parallel to the line of folding of the bottom which has to buckle under the force at appropriate points in order to achieve correct shaping of the bottom; even with correct grooving the result is not certain if the folding has not already been made to operate at least once; even with it having been folded previously, and even if the cardboard is wet, it remains very difficult to open. When the bottom is deployed the line of folding of the bottom is parallel to the lateral sides on which the fingers naturally rest when the cup is grasped in order to drink; this line constitutes a region of weakness possibly leading to the inadvertent closing of the cup with a reduction in volume possibly causing the liquid to overflow.

The patent FR-A-2707467 proposes a solution for dispensing with this line of weakness and for making the unfolding of the bottom more reliable in the case of a concave bottom.

The object of the present invention is to propose a foldable cup, having a convex bottom which is prefolded in such a way that deployment is completely reliable, in particular not comprising a line of folding weakening its locking in open position.

FIG. 1 presents a cutout and grooved blank, seen from above, one of the ends of which has been deleted, with the grooves, in dots and dashes, which allow the cup according to the invention to be shaped.

Figure 1:
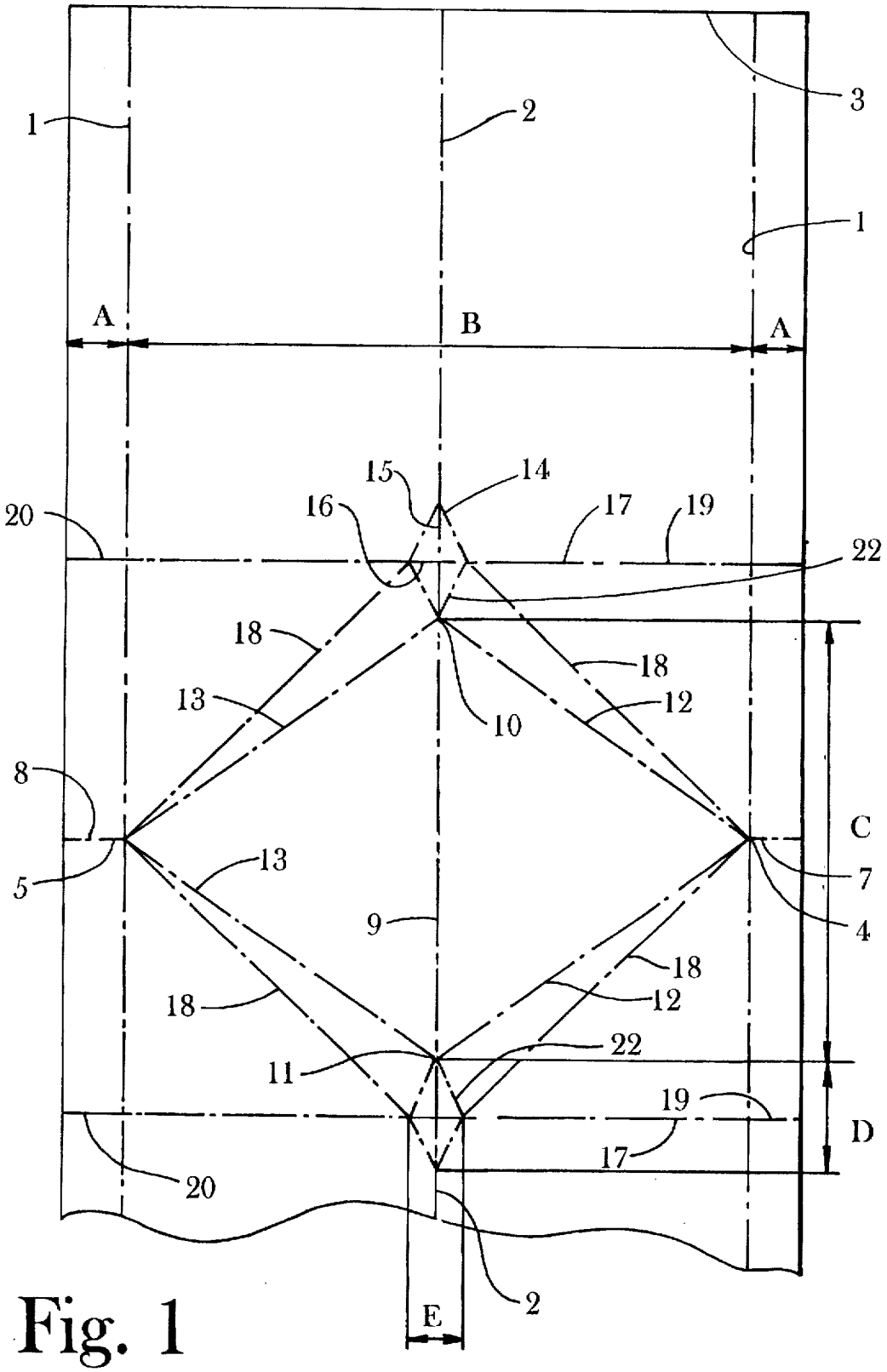

Only the configuration of the bottom of the unfolding cup, and the way in which it is folded and unfolded will be described below; all the configurations relating to the upper edge described in the abovementioned patents are applicable.

Production of this cup starts, for example, with an elongate rectangular semi-rigid sheet (FIG. 1); the length of the long side being, for example, more than twice the length of the short side. Two grooves are formed parallel to the long sides determining strips of width A which serve to fix side walls of the cup to each other; the distance between these two grooves 1 is equal to B. A third groove is placed parallel to the grooves 1 and at an equal distance, equal to B/2, from them. Two points 4 and 5 are preferably placed at equal distance from the short sides 3 of the rectangular sheet, so that the hypothetical straight line joining these two points 4 and 5 is perpendicular to the grooves 1 and 2. Two grooves 7 and 8 of length A start from the points 4 and 5, perpendicular to the grooves 1 and joining the points 4 and 5 to their respective long sides of the sheet. The points 4 and 5 are the vertices of two isosceles triangles having a common base 9 of length C situated on the groove 2; the length C of the common base 9 determines the width of opening of the cup when it is unfolded and must, in particular, be less than the distance B separating the two grooves 1; by way of example, if an opening forming a square is desired, $C=B\times 0.707$ has to be chosen. The sides 12 and 13 of the isosceles triangles respectively joining the vertices 4 and 5 to the vertices 10 and 11 bounding the common base 9 are grooved and bound the bottom of the unfolded cup. On either side of the points 10 and 11 are placed two grooves in the shape of equal diamonds 14, of which the diagonals 15 and 16 are also grooved; the diagonal 15, which is coincident with the mid line 2 has a length $D=(B-C)\times 0.707$, while the diagonal 16 has a length $E=D/2$. Two grooves 17 extend the diagonals 16 of the diamonds 14 perpendicularly to the lines of the grooves 1 and 2; these lines 17 constitute the polygon for supporting the unfolded cup. Finally, the vertices 4 and 5 are joined, by grooves 18, to the ends of the diagonals 16 of the diamonds 14; these lines are the lines for folding the bottom of the folded cup.

In order to form the cup (FIG. 2) the strips of width A, bounded by the grooves 1, are folded in the form of a "W" while forming the bottom of the cup in its unfolded configuration; the two lower points of the "W" consist of the grooves 19 and 20 situated at the ends of the grooves 17, between the grooves 1 and the edges of the sheet, and the central point of the "W" consists of the grooves 7 and 8; the two isosceles triangles with vertex 4 and 5 and common base 9 form a dihedron constituting the convex bottom the intersecting edge of which consists of the common base 9; the polygon for supporting the cup consists, in particular, of a diamond formed by the folding of the sheet on itself along the grooves 17, so that the diamonds 14 are folded on themselves along the diagonal 16, keeping the ends of the intersecting edge of the bottom 9 at a distance equal to D/2 from the support polygon. The side walls of the cup are formed by two dihedrons 21 corresponding to the regions bounded by the grooves 1, 2 and 17 situated on either side of the bottom of the cup. When the cup is thus formed, the contacting faces of the strips of width A folded on themselves in the form of a "W" as previously described can be fixed together; this operation is for the purpose of imperviously linking the edges 1 of the two dihedrons 21 together, in the upper part, and, in the lower part, the edges of the dihedrons 21 to the parts of the strip of width A situated between the grooves 19 and 20 corresponding to the inner part of the "W" folding.

By way of non-limiting example, one approach consists, for making the cup, in using a sheet of cardboard coated on one face with a layer of heat-sealable material impervious to liquids; the folding of the cup takes place with this layer placed on the inside and the strip of width A, when it is folded into a "W", has its coated faces applied against one another; these faces are fixed together by heating through the cardboard; it is necessary, however, to take great precautions as far as the welding is concerned in the region close to the grooves 7 and 8 where the thickness to be welded changes from four thicknesses of cardboard to two thicknesses; the part of the strip of width A situated between the two inner branches of the "W" corresponds to two surfaces in contact which are not coated with heat-sealable material; these can either be left as is, if the cardboard used is sufficiently rigid, or they can be joined by hot bonding, rolling or stapling, without this list being exhaustive.

Folding of the cup (FIG. 3) is achieved, for example, by spacing apart, from the inside, the intersecting edges 2 (FIG. 2) forming the dihedrons of the side faces 21; the diagonals 15 (FIG. 3) of the diamonds 14, the ends 10 and 11 of which are linked by the bottom intersecting edge 9 are folded progressively and the diamonds 14 fold back on themselves, no longer along the diagonal 16 as before, but along the diagonal 15; the dihedrons formed by the intersecting edges 12 and 13 which delimited the dihedron of the bottom are realigned while the intersecting edges 18 are formed so as to form two equal superimposed pentagons constituting the folded bottom having the intersecting edge 9 in common. Each of the pentagons is also bounded by the intersecting edges corresponding to the two grooves 18 (FIG. 1) as well as the grooves corresponding to the sides 22 of the diamonds 14 which link their ends to the ends 10 and 11 of the side 9 common to the two pentagons.

Figure 2:
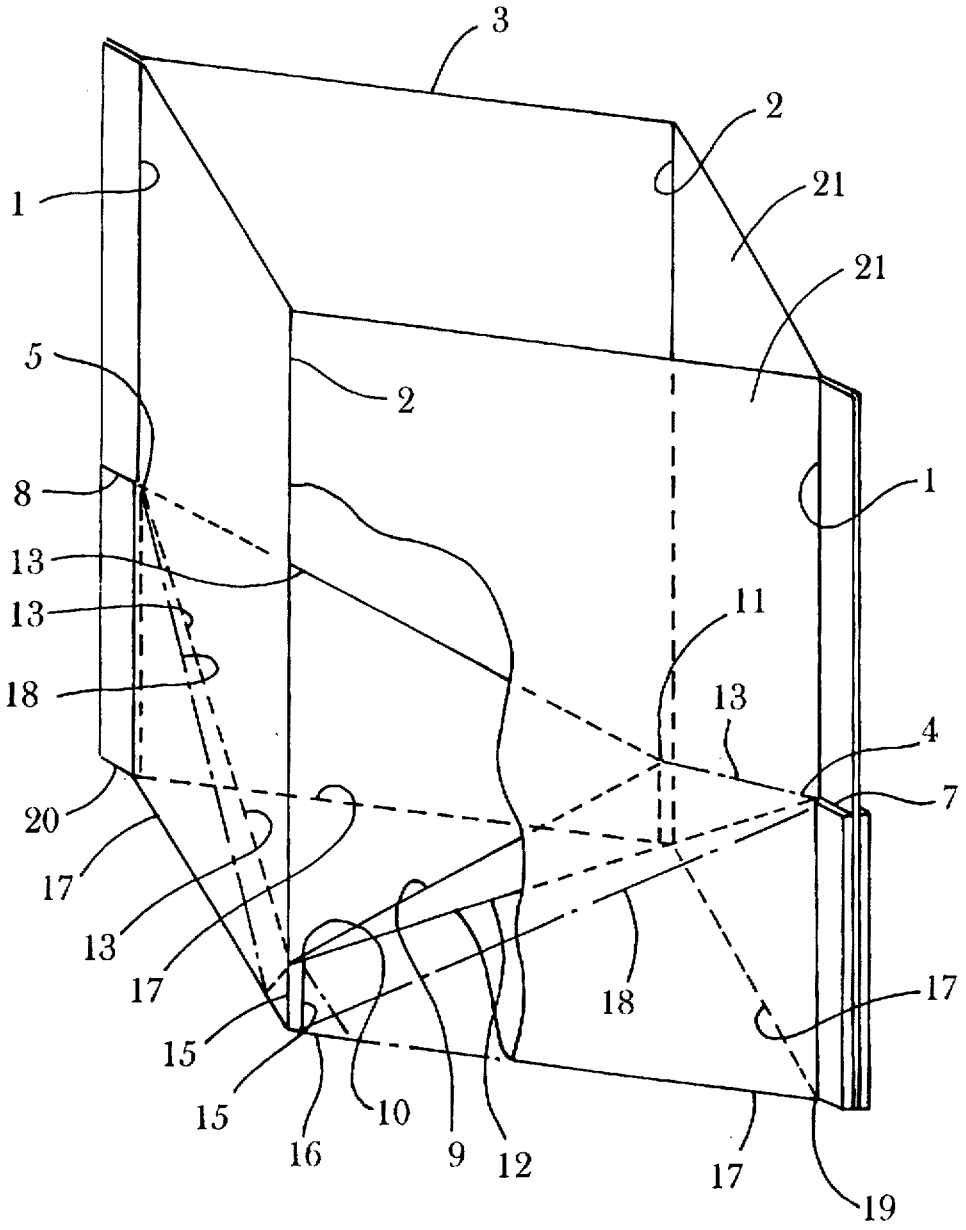
FIG. 2 represents a view in perspective of the cup corresponding to the blank of FIG. 1, shaped into unfolded position which has been cut away to show the inside thereof.

In order to open the cup, hitherto folded as previously described, it is sufficient to press on the intersecting edges 2 (FIG. 3), squeezing them, for example, between the thumb and the index finger. The dihedrons forming the side faces open out, the diamonds 14 deploy so as then to fold back on themselves, along the diagonal 16, until the ends 10 and 11 of the bottom intersecting edge 9 come into abutment on the intersecting edge 2 of the dihedrons 21 (FIG. 2).

This cup can be manufactured continuously from a reel, the machine width of which is equal to the length of the long side of the rectangular sheet which is used at the outset to form the cup, using a method identical to that described in the abovementioned patents.

Figure 4:
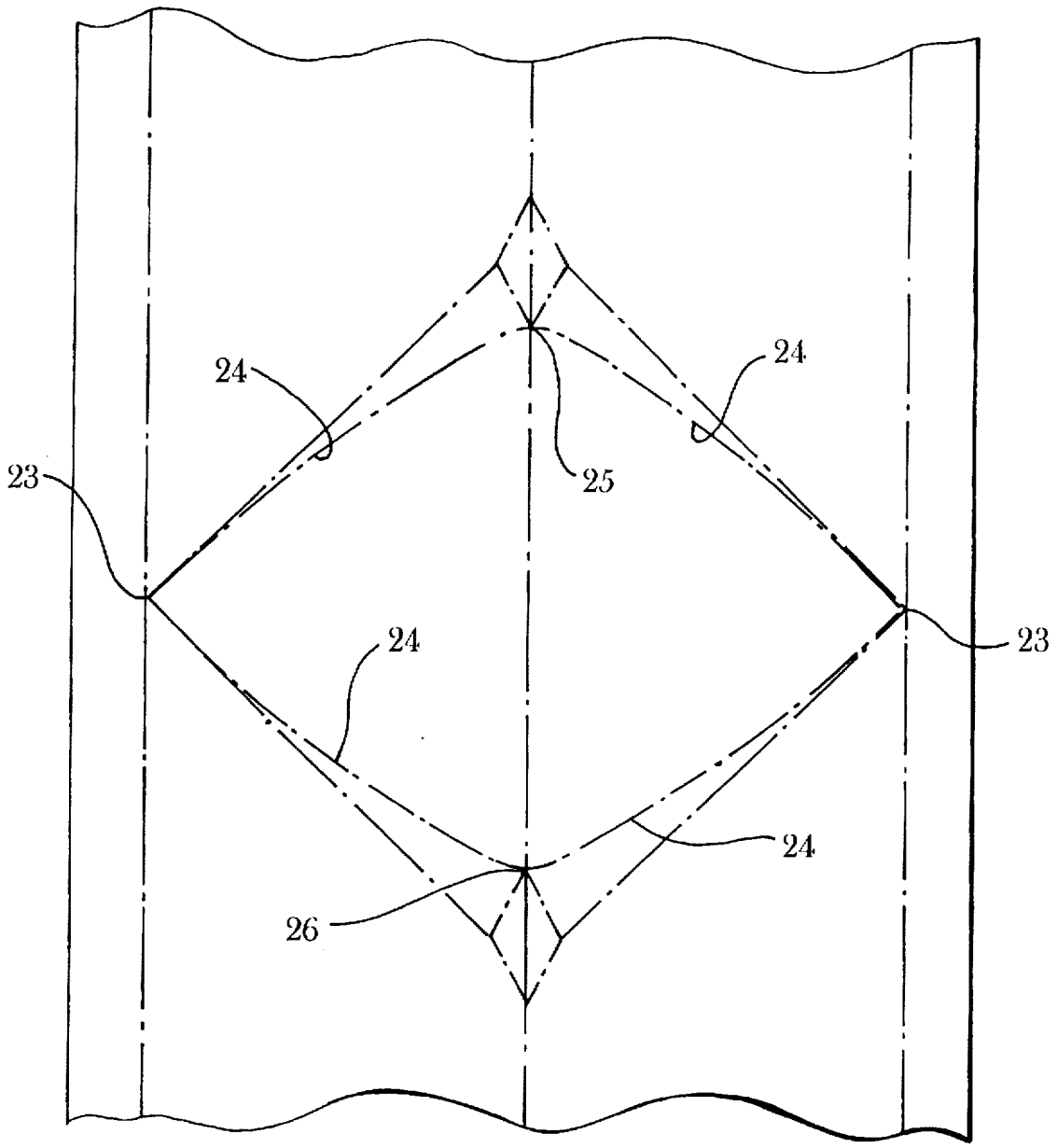
FIG. 4 represents a cut-out and grooved blank, seen from above, according to one variant of the invention.

According to the variant of FIG. 4, the sides adjacent to the vertices 23 of the isosceles triangles forming the bottom of the unfolded cup are replaced by curved grooves 24 with the same curvature situated either externally as indicated in FIG. 4, or internally, to the triangles with vertices 23, 25, 26.

Figure 5:
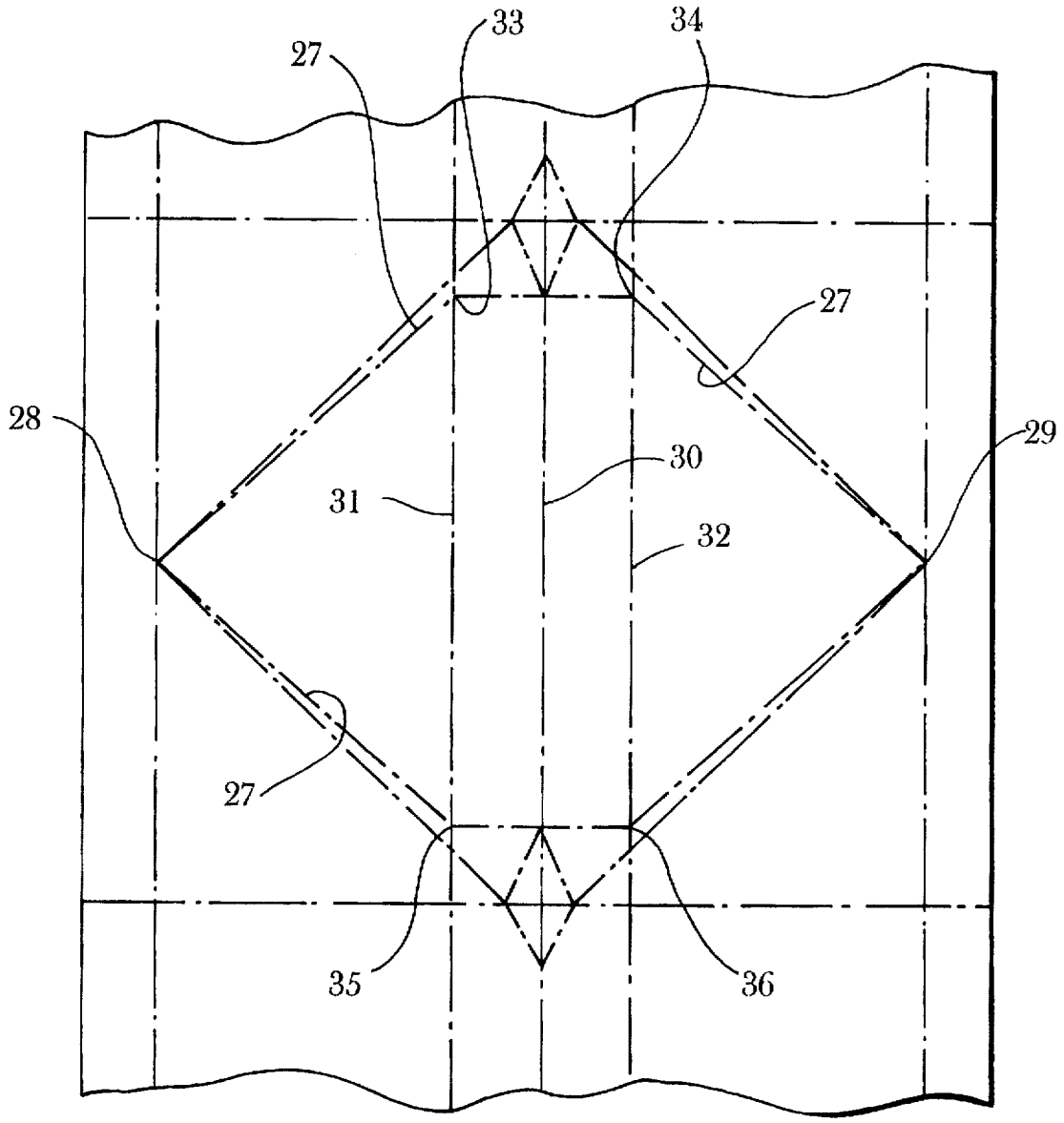
FIG. 5 represents a cutout and grooved blank, seen from above, according to another variant of the invention.

According to the other variant of FIG. 5, the grooves 24 of FIG. 4 are replaced by four grooves 27 formed by a succession of straight-line segments forming a convex polygon having an axis of symmetry with respect to the line joining the vertices 28 and 29. Grooves 31 and 32 pass through each pair of symmetric vertices 33 and 35 on the one hand, and 34 and 36 on the other hand. These grooves are parallel to the mid-line groove 30.

Figure 6:
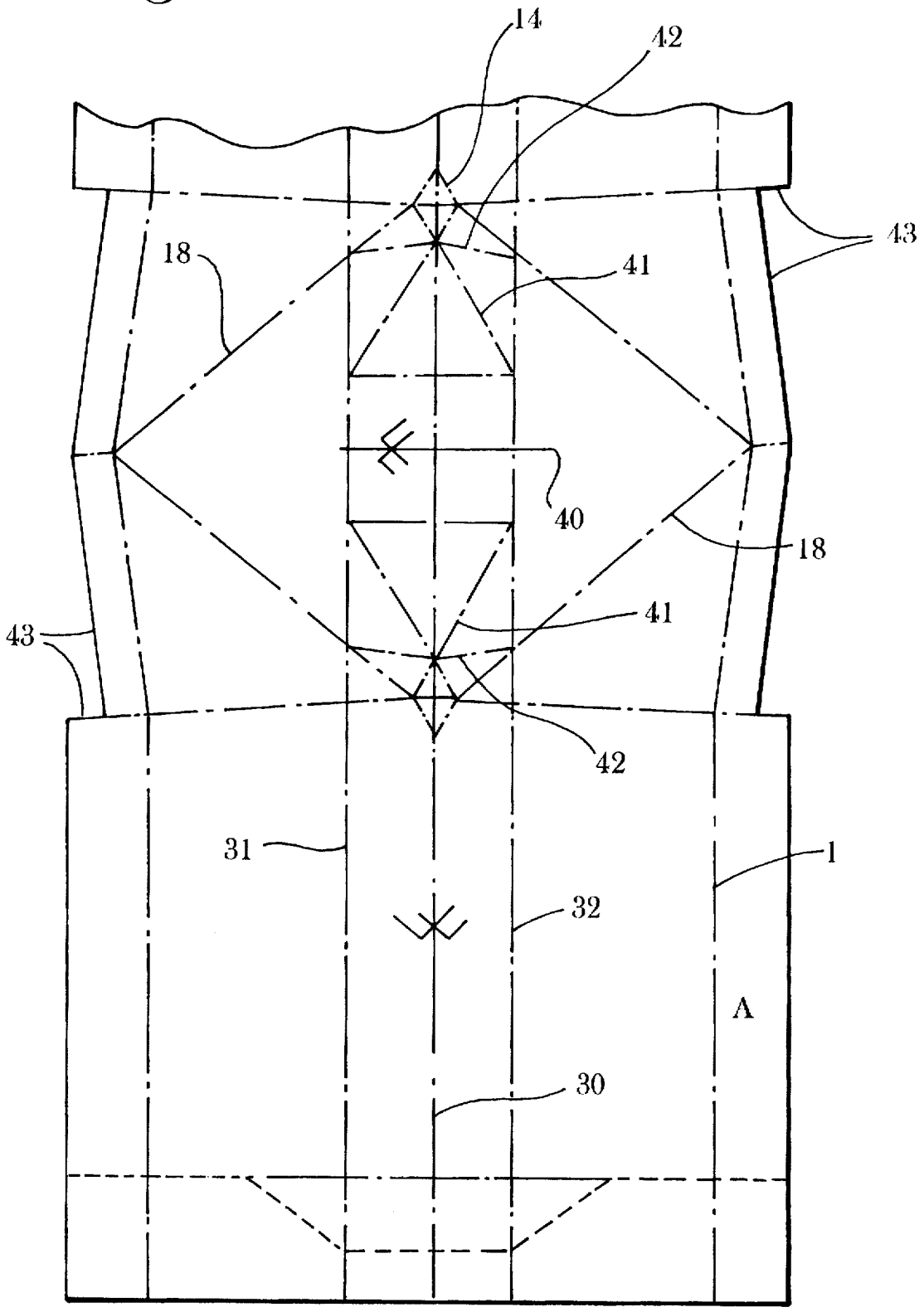
FIG. 6 shows a cutout and grooved blank seen from above, of another variant of the invention.

In the variant of FIG. 6, the grooves 18 of FIG. 1, those 31 and 32 of FIG. 5 which are parallel to the mid-line groove 30 and the diamond-shaped regions 14 are again found, in combination. On either side of the transverse median axis 40 of the blank two small isosceles triangles 41 are created, by grooving, inscribed, by their small base, between the parallel grooves 31 and 32, their vertex joining the diamond-shaped regions 14. Two grooves 42, passing through the common vertices of the isosceles triangles 41 and of the diamonds 14, and linking the parallel grooves 31 and 32, complete the assembly. It will be noted that the long sides of the blank bounding the strips A with the grooves 1 are cut out along two notches 43 starting from the transverse median axis 40 and joining transverse grooves 44 passing through the diamonds 14.

Figure 3:
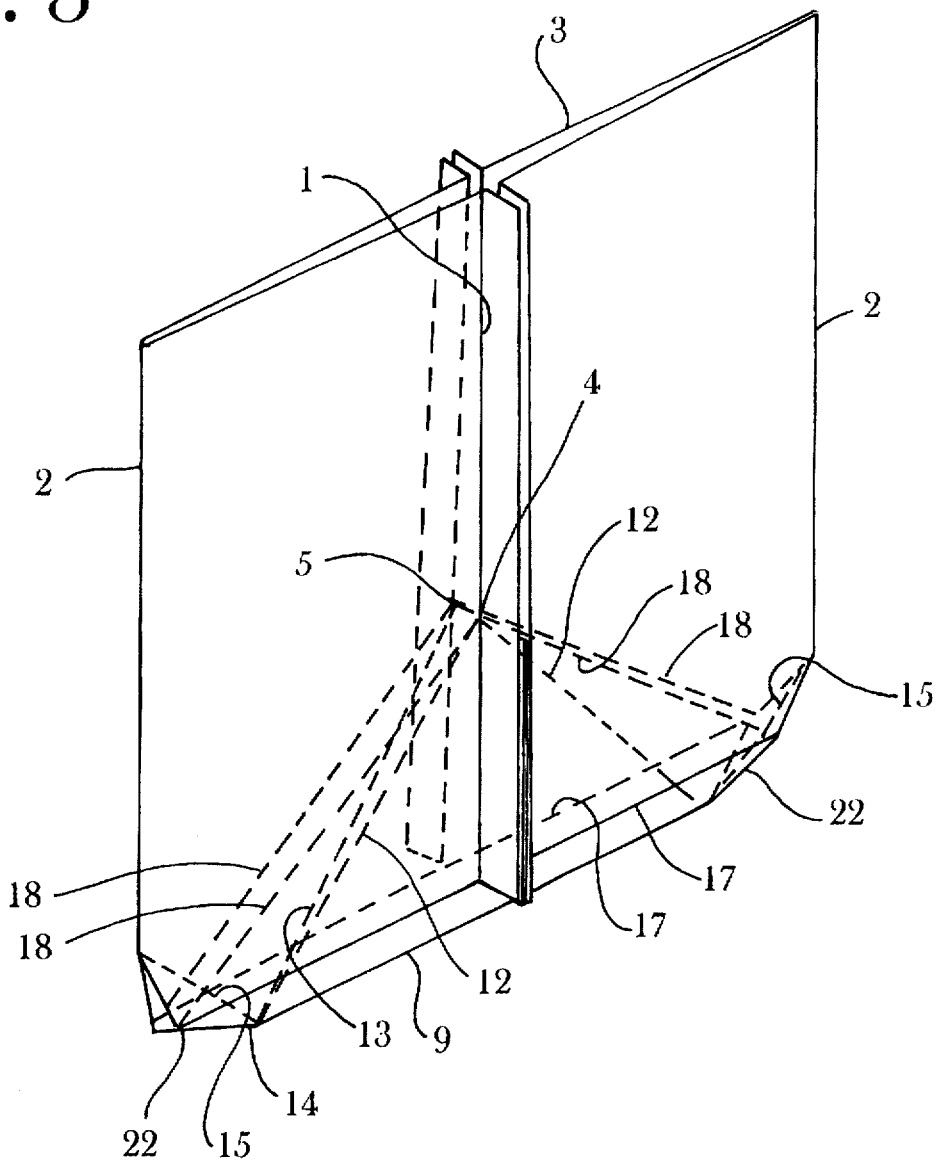
FIG. 3 represents the cup of FIG. 2 folded according to the invention.

When the cup thus obtained is folded, it cannot be distinguished from the folded cup represented in FIG. 3; on the other hand, when it is unfolded, the side walls no longer form two dihedrons as shown in FIG. 2, but two polyhedrons.

Figure 7:
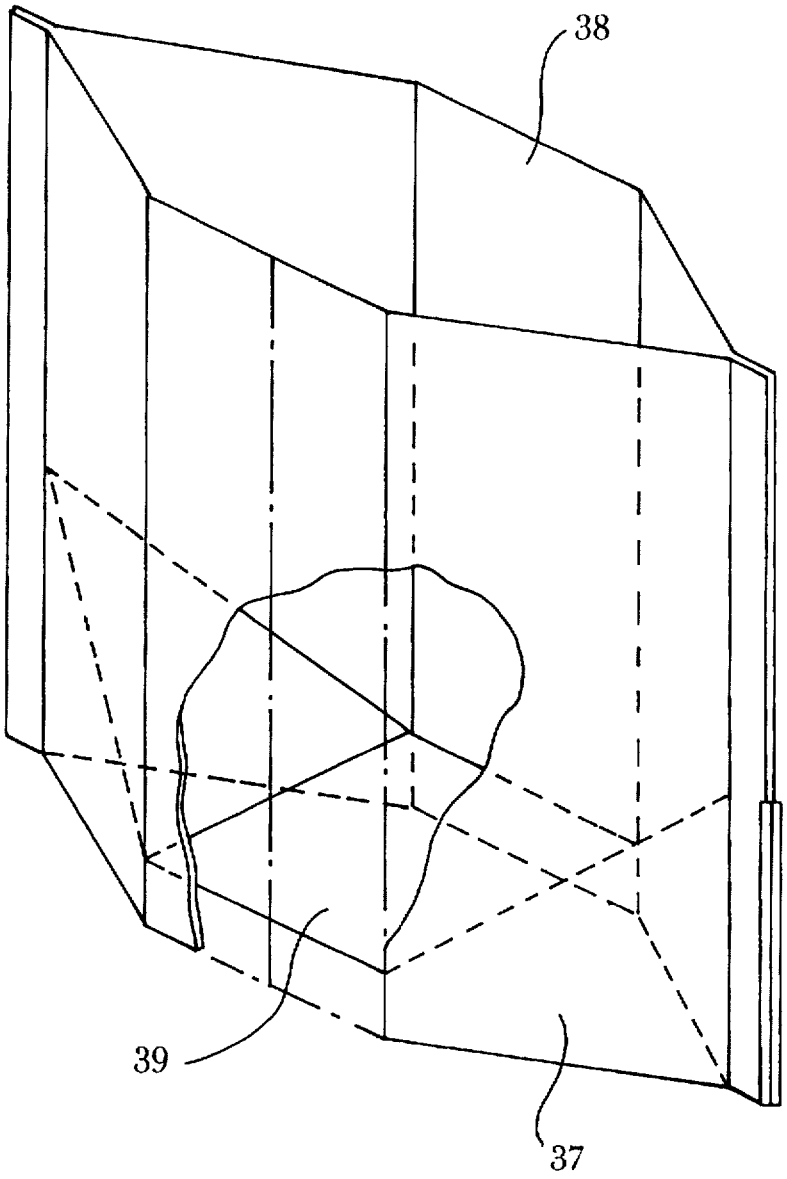
FIG. 7 represents a view in perspective of the cup corresponding to the blanks of FIGS. 5 and 6 shaped into unfolded position which has been cut away to show the inside thereof.

FIG. 7 represents the cup corresponding to the blanks of FIGS. 5 or 6 in which the side walls are formed by two trihedrons 37 and 38. The bottom of the cup no longer forms a dihedron as represented in FIG. 2, but a polyhedron 39.

The advantage of these variants is, on the one hand, of forming a polygonal edge, for example hexagonal, from which it is easier to drink and, on the other hand, of forming a polygonal bottom which is partially flat in order to facilitate stirring the liquid contained with a spoon.

We claim:

1. Unfolding cup obtained by folding of an elongate rectangular flat sheet comprising, parallel to its length, two edges of width A framing a region of width B in which the side walls (21) of the cup are formed in the shape of a dihedron which are linked by a convex bottom obtained by prior folding of the borders of width A in a "W" shape, characterized in that the convex bottom is produced by the combination of grooves (12, 13, 18, 22) bounding two isosceles triangles inscribed in two pentagons having a common base (9, 30) of length C, less than B, situated on the mid-line longitudinal axis (2) of the sheet and common vertices (4, 5), (23), (28, 29) situated in the middle of the grooves (1) bounding the borders of width A, while each of their ends (10, 11), (25, 26) and (33–36) is common to a vertex of a diamond-shaped region (14) the long diagonal (15) of which is in the extension of the common base (9, 30) of the triangles and pentagons and the deformation of which, leading to folding of the said diamond (14) along one or the other of its diagonals (15, 16) allows unfolding and refolding of the cup.

2. Cup according to claim 1, characterized in that, when it is unfolded, the diamonds (14) are folded on themselves along their short diagonal (16) their ends (10, 11) of which come into abutment on the intersecting edge consisting of the mid-line groove (2) of the side faces (21).

3. Cup according to claim 1, characterized in that, when it is folded, the diamonds (14) are folded on themselves along their long diagonal (15), so that the isosceles triangles and the pentagons, forming the bottoms, are superimposed.

4. Cup according to claim 1, characterized in that the diagonal (15) of the diamond (14) has a length $D=(B-C)\times 0.707$ and the diagonal (16) has a length $E=D/2$.

5. Cup according to claim 3, characterized in that the unfolding of the cup can be achieved by pressing on the intersecting edges (2) of the dihedrons 21 constituting the side walls of the cup so as to bring them together until they come into abutment on the ends (10) and (11) of the common base (9).

6. Cup according to claim 1, characterized in that the straight-line grooves bounding the isosceles triangles forming the bottom are replaced by curved grooves (24) joining the vertices (23) to the vertices (25) and (26) of the said triangles.

7. Cup according to claim 6, characterized in that the curved grooves (24) are replaced by four grooves (27) forming a convex polygon having an axis of symmetry with respect to a line joining the vertices (28) and (29) and in that grooves (31) and (32) passing through each pair of symmetric vertices (33, 35) and (34, 36) are parallel to a mid-line groove (30) in such a way that, when the cup is unfolded, the side walls (38) and the bottom (39) form polyhedrons.

8. Cup according to claim 7, characterized in that two small isosceles triangles (41) inscribed between the parallel grooves (31, 32) joining the diamonds (14) are created, by grooving, and in that the long sides of the blank bounding the borders A with the grooves (1) have notches (43) cut out, which are situated on either side of the mid-line axis (40) and transverse grooves (44) passing through the diamonds (14) in such a way that, when the cup is unfolded, the side walls (38) and the bottom (39) form polyhedrons.

9. Cup according to claim 1, characterized in that the cup is produced from a sheet of cardboard including a layer of impervious and heat-sealable material on one face.

* * * * *